US009901193B2

(12) United States Patent
Nikolov et al.

(10) Patent No.: US 9,901,193 B2
(45) Date of Patent: Feb. 27, 2018

(54) MIRROR ASSEMBLY

(71) Applicant: Synergy Products Inc., Chicago, IL (US)

(72) Inventors: Simeon Nikolov, Chicago, IL (US); Evan Ward, Chicago, IL (US)

(73) Assignee: Synergy Products, Inc., Chicago, IL (US)

( * ) Notice: Subject to any disclaimer, the term of this patent is extended or adjusted under 35 U.S.C. 154(b) by 124 days.

(21) Appl. No.: 14/794,896

(22) Filed: Jul. 9, 2015

(65) Prior Publication Data

US 2016/0051034 A1 Feb. 25, 2016

Related U.S. Application Data

(60) Provisional application No. 62/039,893, filed on Aug. 20, 2014.

(51) Int. Cl.

| | |
|---|---|
| ***A47G 1/04*** | (2006.01) |
| ***A45D 42/10*** | (2006.01) |
| ***A45D 42/16*** | (2006.01) |
| ***A45D 42/18*** | (2006.01) |
| *A45D 42/14* | (2006.01) |

(52) U.S. Cl.

CPC ..... *A47G 1/04* (2013.01); *A45D 42/10* (2013.01); *A45D 42/16* (2013.01); *A45D 42/18* (2013.01); *A45D 42/14* (2013.01)

(58) Field of Classification Search

CPC ..... A47G 1/04; A45D 42/16; A45D 42/18
USPC ..... 359/841, 850, 854, 855, 860, 865, 879, 359/881

See application file for complete search history.

(56) References Cited

U.S. PATENT DOCUMENTS

| | | | | | |
|---|---|---|---|---|---|
| 71,320 | A | * | 11/1867 | Neagle | A45D 42/18 359/860 |
| 84,943 | A | * | 12/1868 | Furber | A45D 42/18 359/860 |
| 115,898 | A | * | 6/1871 | Roberts | A45D 42/18 359/860 |
| 207,579 | A | * | 8/1878 | Wilcox | A45D 42/18 359/860 |
| 751,290 | A | * | 2/1904 | Jaeger | A45D 42/18 359/860 |
| 1,994,126 | A | | 3/1935 | Eddy | |
| 2,465,428 | A | | 3/1949 | Brown | |
| 2,489,506 | A | * | 11/1949 | Seutin | A45D 42/18 359/854 |

(Continued)

FOREIGN PATENT DOCUMENTS

| | | |
|---|---|---|
| CN | 201640859 | 4/2010 |

*Primary Examiner* — Ricky D Shafer

(74) *Attorney, Agent, or Firm* — Stephen T. Scherrer; Monique A. Morneault; Scherrer Patent & Trademark Law, P.C.

(57) ABSTRACT

A mirror assembly is provided. The mirror assembly includes at least two mirrors, which when positioned relative to one another, allows a user to see the front and back of his/her head and neck simultaneously. The present mirror assembly is useful for daily grooming activities, including shaving and hair styling, where it may be advantageous to see both the front and back of the head simultaneously. The mirror assembly can be folded into a compact stored position on the when not in use, so that the entire assembly rests compactly against a wall, yet is easily expanded and adjustable for use.

8 Claims, 5 Drawing Sheets

(56) References Cited

U.S. PATENT DOCUMENTS

| | | | | | |
|---|---|---|---|---|---|
| 2,763,186 | A * | 9/1956 | Barlow | A47G 1/04 | 160/220 |
| 3,730,612 | A * | 5/1973 | Arroyo | G02B 5/08 | 248/476 |
| 4,775,231 | A * | 10/1988 | Granzow | G02B 7/1824 | 359/854 |
| 7,300,169 | B1 * | 11/2007 | Yue | A45D 42/18 | 359/854 |
| 2005/0195507 | A1 * | 9/2005 | Gonzalvo | B60R 1/082 | 359/862 |
| 2013/0161473 | A1 * | 6/2013 | Gandiboyina | A47G 1/08 | 248/467 |

* cited by examiner

MIRROR ASSEMBLY

This application claims priority under 35 U.S.C. § 119(e) to U.S. Provisional Patent Application No. 62/039,893 filed on Aug. 20, 2014, which is incorporated by reference herein in its entirety.

TECHNICAL FIELD

The present invention relates to a mirror assembly. Specifically, the present disclosure relates to a hands-free, adjustable mirror assembly, having at least two mirrors, wherein at least one of the mirrors is adjustable relative to the other mirror to permit various views.

BACKGROUND

It is of course, generally known to use a mirror when performing bathing and grooming activities. Wall mounted mirrors are common features, if not a necessity, to every bathroom, and often found in other areas of the home. Daily grooming activities are generally performed using a wall mounted mirror, which provides the users with a front view. However, both men and women often need to see both the front and the back of their head and neck area while performing daily grooming activities, including shaving, brushing and/or styling hair, and other grooming activities.

Typically, in order for a person to see the back of his/her head or neck, it is often necessary to hold a second hand-held mirror in front of his/her face with one hand, while having his or her back to a larger mirror positioned behind them. However, this method leaves only one hand free. Many grooming activities, such as hair styling and brushing, neck shaving, hair drying, and rinsing out hair products, such as shampoo and conditioner, are often more efficiently accomplished with two hands.

To date, there are no hands-free devices or products on the market that can be mounted to a wall that allows the user to effectively see both the front and back of their head while engaged in the above listed grooming tasks. In addition, there are no hands-free devices or products on the market incorporating at least two mirrors to allow the user to effectively see both the front and back of their head, as needed. Furthermore, there are no hands-free devices or products that can be mounted to both a shower area wall, a wall in the general bathroom area, or in any other suitable area. Previous attempts to create such a device included attaching devices, such as mirrors, to the shower head, or chairs; however, none of these ideas have been widely successful either in use or in the market.

Therefore, a need exists for a mirror assembly that is easily adjustable and provides the user with multiple views.

Further, a need exists for a mirror assembly that permits the user to see the front and back of his/her head and/or neck simultaneously.

In addition, a need exists for a mirror assembly that provides hands-free use. Moreover, a need exists for a mirror assembly that is easily collapsible into a compact unit for convenient storage.

SUMMARY OF THE INVENTION

The present invention relates to a mirror assembly, and specifically, an adjustable vanity mirror assembly. The adjustable mirror assembly is useful during various grooming activities, such as shaving or hair styling, as it provides the user with a hands-free option for simultaneously viewing the front and the back of the user.

To this end, in an embodiment of the present disclosure, a mirror assembly is disclosed. The mirror assembly comprises a housing having a frame, a first mirror secured within frame, at least one moveable arm connected at a first end to the housing, a second mirror connected to a second end of the movable arm, wherein the second mirror is adjustable between a closed positioned and at least one open position relative to the first mirror.

In another embodiment of the present disclosure, a vanity mirror assembly is disclosed. The vanity mirror assembly comprises a housing having a frame, a stationary base mirror centrally positioned within the frame, a supporting rail extending above the frame, at least one arm connected at a first end to the supporting rail, a moveable mirror connected to a second end of the arm, wherein the movable mirror is adjustable through the arm between a closed positioned adjacent the base mirror and at least one open position extending away from the base mirror.

In yet another embodiment of the present disclosure, a vanity mirror assembly is disclosed. The vanity mirror assembly comprises a housing having a frame, a stationary base mirror centrally positioned within the frame, a supporting rail extending above the frame, at least one articulating arm connected at a first end to the supporting rail, a movable mirror connected to a second end of the arm, wherein the movable mirror is adjustable through the articulating arm between a closed position adjacent the base mirror and at least one open position extending away from the base mirror, and wherein in the open position a reflective surface of the movable mirror faces a reflective surface of the base mirror.

It is, therefore, an advantage and objective of the present invention to provide a vanity mirror assembly that is adjustable into a plurality of configurations providing the user with multiple viewing options during grooming activities, including shaving and hair styling.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present invention relates to a mirror assembly. More specifically, the present disclosure relates to a vanity mirror assembly including at least two mirrors that are capable of being adjusted relative to each other and providing the users with a plurality of views. The present mirror assembly provides the user with a hands-free device for use during personal care and grooming activities, such as shaving and hair styling, but is not necessarily limited to these activities.

Now referring to the figures, wherein like numerals refer to like parts, FIGS. 1-5 illustrate a mirror assembly 10, including a vanity mirror assembly. The mirror assembly 10 generally includes housing 12, and at least two mirrors—a first, stationary base mirror 14 and a second, adjustable or moveable mirror 16. The ability to position the first mirror 14 in relation to the second mirror 16 allows the user to easily see both the front (face) and the back of the head and neck while performing personal grooming tasks. In the present embodiment, two mirrors are shown and described. However, it should be understood that any number of mirrors may be used in the present assembly. The mirror assembly 10 can be mounted to a variety of wall surfaces, including tile, drywall, laminate and plaster using known attachment methods, including suctions cups, adhesive mounts, and screws.

The present mirror assembly 10 can be used in the general bathroom area, shower area, or any other convenient area of the household. Although the present mirror assembly is highly useful from daily grooming activities, such as shaving and hair styling, it may also be used for any other application that requires adjustable mirrors, including dressing and adjusting or securing jewelry. Cordless LED lights may be added to the first mirror 14 to enhance viewing in the often darker lighting conditions of the bathroom and/or shower area. Additionally, the mirrors are fog resistant, and the entire mirror assembly 10 is water-resistant.

Figure 2:
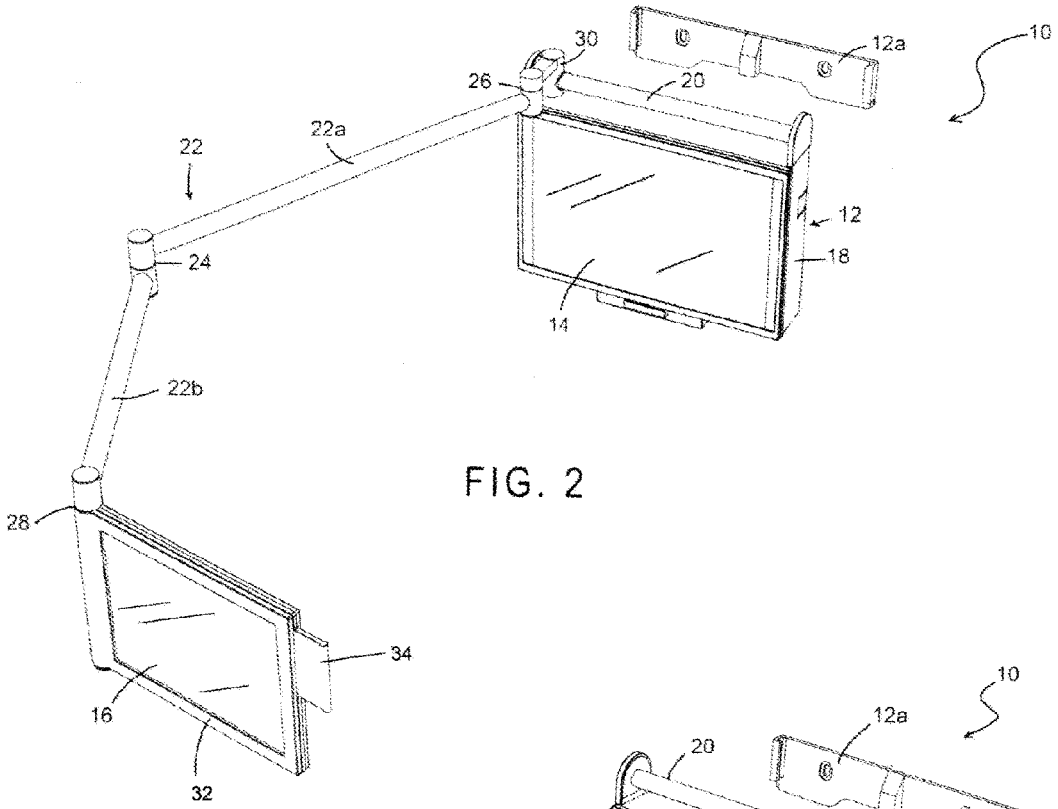
FIG. 2 illustrates a perspective view of the mirror assembly of the present disclosure in an open position.
Figure 3:
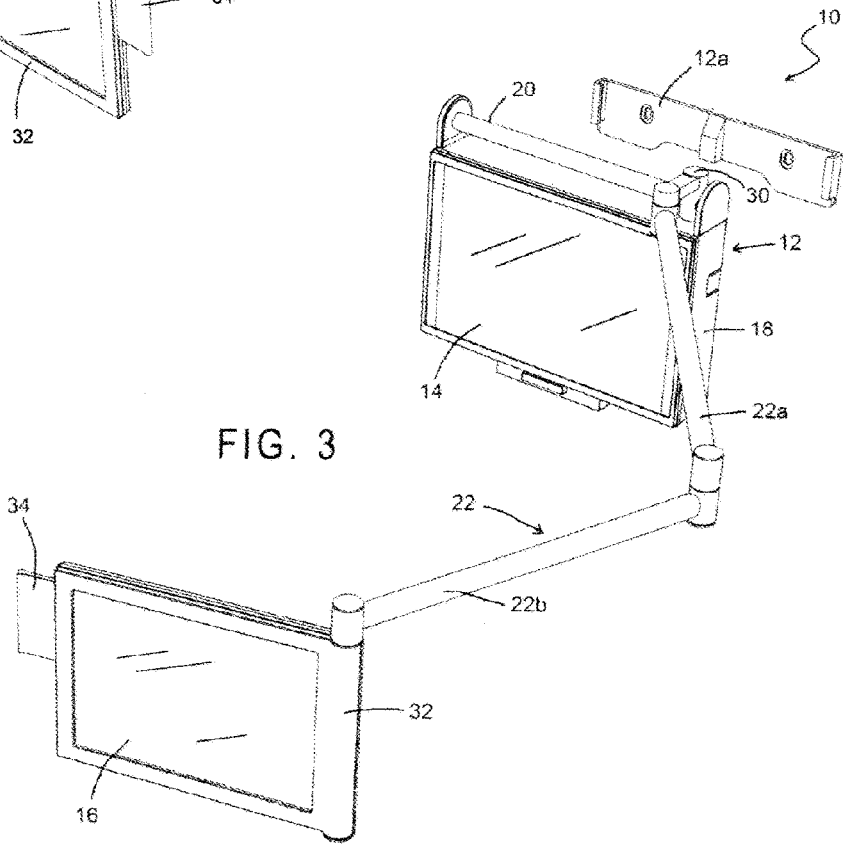
FIG. 3 illustrates a perspective view of the mirror assembly of the present disclosure in a second open position.

As shown in FIGS. 2 and 3, the present assembly 10 includes a housing 12 having a frame 18 for receiving and securing a first or base mirror 14. The housing 12 may be constructed from any suitable materials, including corrosion resistant metals, such as stainless steel, steel, and aluminum, or plastic. In addition to the first or base mirror 14, the housing 12 may incorporate LED lights (not shown), slots and hooks (not shown) to accommodate accessories, such as razors and grooming or styling tools. The housing 12 further includes a mounting bracket 12*a*, for mounting the assembly to a wall 100 using known methods. For example, the housing may be snap fit onto the mounting bracket 12*a* after the bracket is mounting to the wall or other supporting surface. In this manner, the first mirror 14 is generally stationary relative to the second mirror 16, yet the housing 12 is removable from the mounting bracket 12*a* for ease in replacing light bulbs that may be included in the mirror.

The housing 12 further includes a supporting or top rail 20. The supporting rail 20 is integrally formed with and extends above the frame 18 housing the first mirror 14. The supporting or top rail 20 may be constructed from any suitable materials including extruded plastic, stainless steel, steel, or aluminum.

Connecting the first mirror 14 and the second mirror 16 is an arm 22, and specifically an articulating or adjustable arm. In one embodiment, the arm 22 is divided into at least two segments 22*a* and 22*b*, which are joined together using a connector 24, such as hinge or a pin (FIGS. 4 and 5), which permits the arm segments 22*a*, 22*b* to move or articulate into a plurality of positions. Although the arm 22 is shown divided into two segments, it should be understood that the arm may be divided into any number of segments. Movement of the arm segments may be together or independent from one another. The arm 22 may be constructed from molded or extruded plastic, stainless steel, steel or aluminum.

The arm 22 is further connected at a first connection end 26 to the supporting or top rail 20, and at a second connection end 28 to the second mirror 16. In one embodiment, the first connection end 26 includes a sleeve 30 surrounding the top rail 20, which permits the arm 22 to slide laterally along a the length of the top rail into a plurality of positions. For example, FIGS. 2 and 3 illustrate the arm 22 slidably moveable through the sleeve 30, which is slidably positioned at different positions along the length of the top rail 20 and housing 12. The top rail 20 may also include a channel (not shown) for receiving the first end of the arm. In this manner, the first end 26 of the arm 22 would be secured within the channel yet have the ability to laterally slide within the channel to either side of the rail and housing.

As shown in FIGS. 2 and 3, a second or moveable mirror 16 is attached to the arm 22, at the second segment 22*b*. The second mirror 16 can connected to the second connection end 28 of the second segment 22*b* of the arm 22 through any known connector, such as a pin. This connection allows the moveable second mirror 16 to horizontally rotate 360 degrees from a starting position about the connection end 28 of the second segment 22*b* of the arm 22. The ease in mobility of the second mirror 16 provides the user with the ability to easily adjust the mirror into a desired position.

As shown, the second mirror 16 includes a surrounding frame 32, which may also include an optional handle 34. The surrounding frame 32 secures and protects the mirror, and can be constructed from plastic, stainless steel, steel, or aluminum. It should be understood, however, that the second mirror may also be frameless. The mirror 16 may be one piece including two mirrored sides, or two pieces, each with one mirrored side, and have any suitable shape including, but not limited to round, rectangular or square. The mirror is generally fog resistant.

Figure 4:
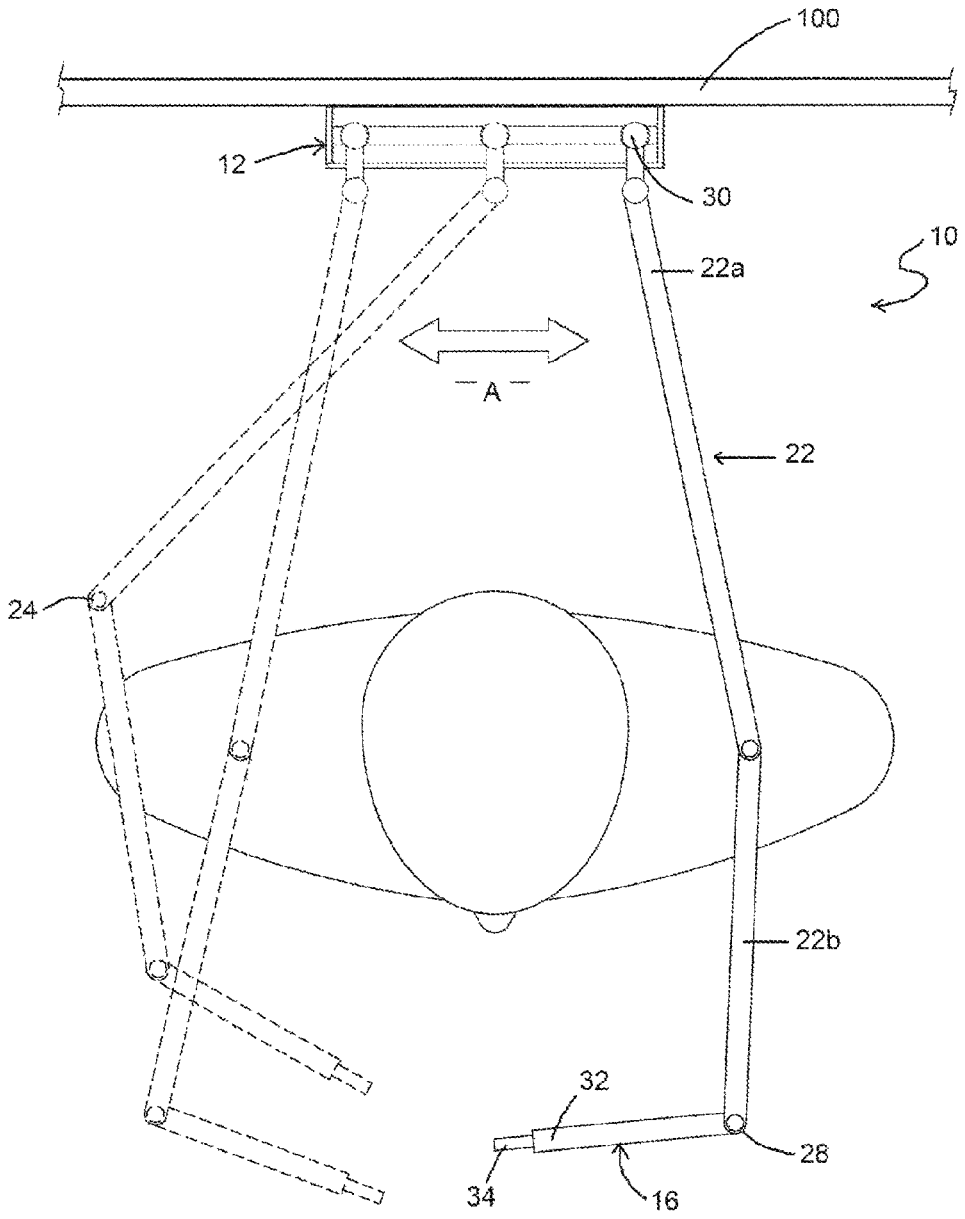
FIG. 4 shows on plan view of the mirror assembly mounted of the present disclosure in use.
Figure 5:
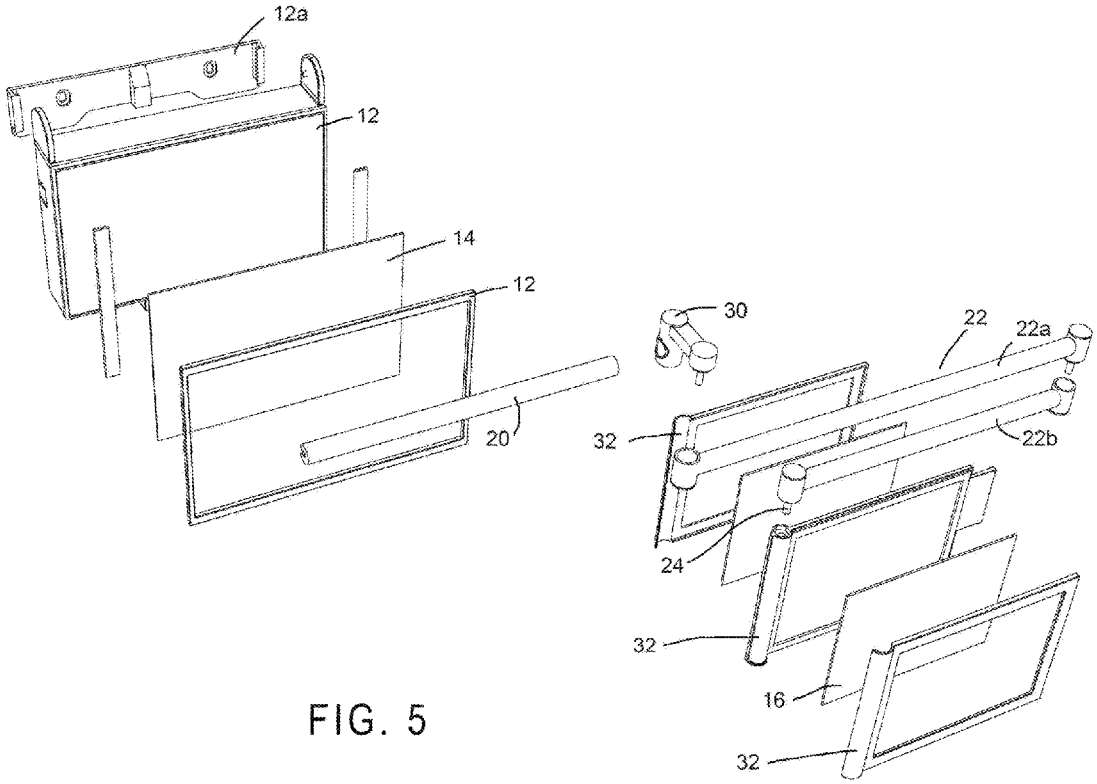
FIG. 5 illustrates an exploded view of the mirror assembly of the present disclosure; and, FIG. 6 illustrates an exploded view of an alternative embodiment of the supporting rail of the mirror assembly of the present disclosure.

As shown in FIG. 4, and in one embodiment, the present mirror assembly 10 is useful for viewing the front and back of the user's head and neck simultaneously. The present mirror assembly 10 works as a self-contained device, consisting primarily of the first, generally larger wall mounted mirror 14, and the adjustable, generally smaller, second mirror 16. It should be understood, however, that the mirrors can vary in size relative to one another or be the same size.

As described, the first mirror 14 and the second mirror 16 are connected to one another by the two-segment articulating arm 22. When in use, the second mirror 16 can be pivoted outward from the first mirror 14 on the two-segment articulating arm 22, easily positioning the second mirror 16 in front of and away from the first mirror 12. In this manner, the user can see the back of his or her head and/or neck in the first mirror 14, when the user is standing in front of, and with his/her back to, the first mirror.

In an embodiment, the second mirror 16 is a double sided mirror, which also has the ability to pivot horizontally from its connection end 28 with the two-segment arm 22. The second two-sided mirror 16 can pivot 360 degrees from an initial position. Additionally, by sliding the arm 22 along the top rail either right or left in the direction of "A", the user can place the second mirror 16 just to the left or right of the user or head of the user, where it optimally needs to be to see the back of the head and/or neck. At the point where the two-segment arm 22 attaches to the first mirror 14, either through the sleeve 30 or channel (not shown), the second mirror 16 can both pivot and slide laterally on the rail 20, or channel, which allows for greater adjustability of the mirror assembly from right to left.

Figure 6:
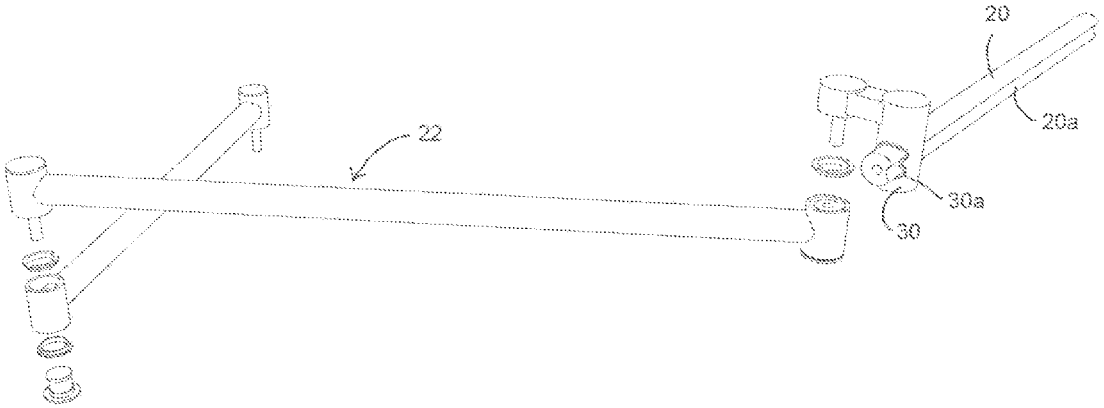

FIG. 6 illustrates an alternative embodiment of the top or supporting rail 20. In this embodiment, the top rail 20 includes a notch 20*a* extending laterally along the length of the rail. The sleeve 30, connecting the arm 22 to the top rail 20, includes an opening 30*a* configured to receive the notch 20*a* of the top rail. As shown in FIG. 6, when the notch 20*a* of the top rail 20 engages the opening 30*a* of the sleeve 30, the top rail is prevented from rotating about a horizontal axis. This configuration provides a stable support for the arm 22.

The adjustability and options provided by the present mirror assembly 10 provide the advantage of permitting the user to move the mirrors 14, 16 into any suitable configuration to better suit his/her grooming tasks and needs. The combination of the articulating arm 22 to slide laterally on the first mirror 14, combined with the adjustability of the second mirror 16 provides a highly ergonomic, adjustable, compact, yet expandable mirror assembly 10.

Figure 1:
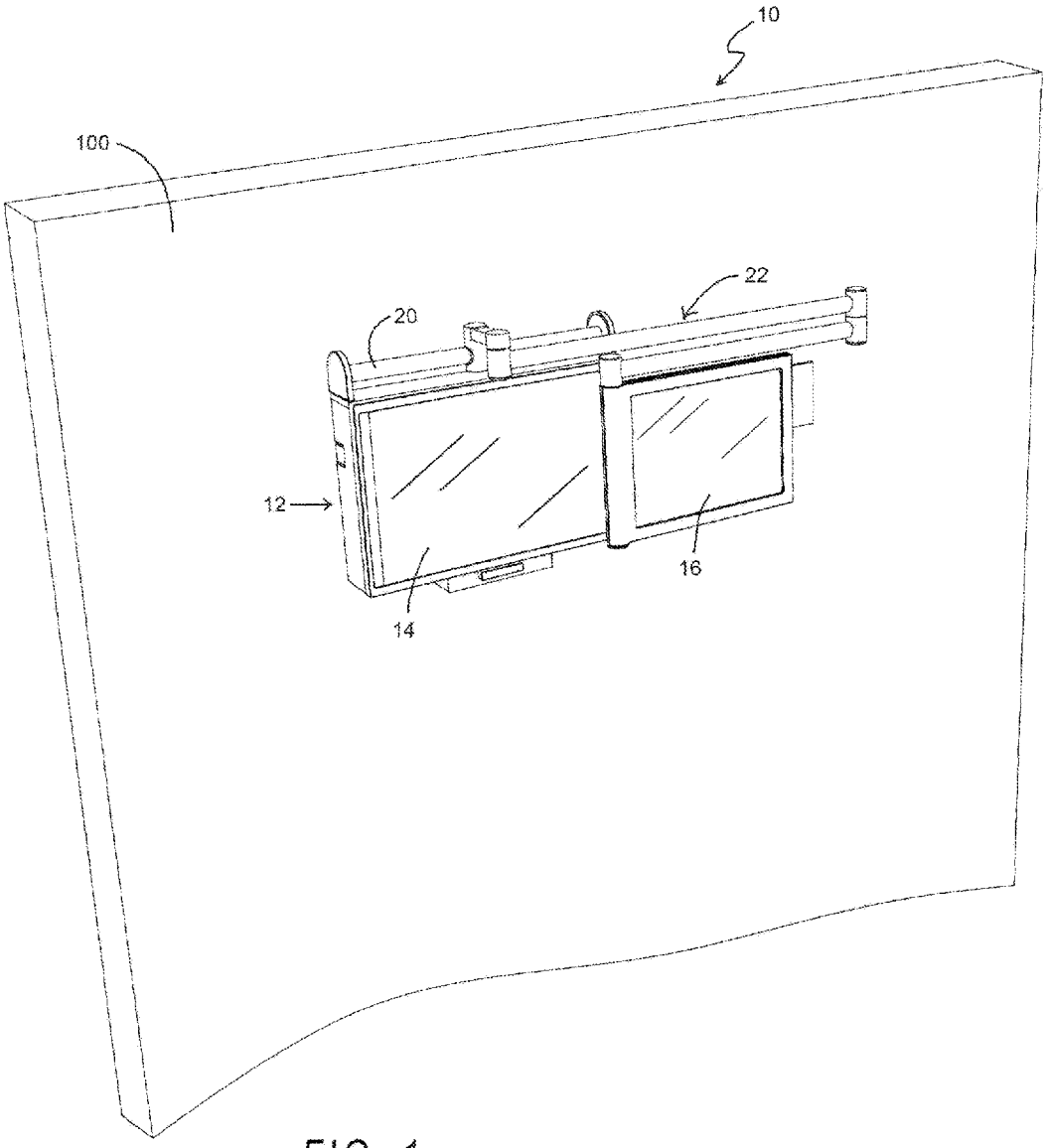
FIG. 1 illustrates a perspective view of the mirror assembly of the present disclosure in a closed position.

As shown in FIG. 4, once the first base mirror 14 is mounted to a wall 100 through its housing 12, the user pulls out (extends) the second mobile mirror 16, and stands facing away from the first base mirror 14. Using the articulating arm 22, the user adjusts the location of the mobile mirror 16 so that the user can see the back of his/her head/neck area reflected from the base mirror. The user can then easily slide the extended arm 22 holding the mobile mirror 16 left or right on the rail 20 located on the base mirror to position the mirror to the right or left side of their head, depending on the user's needs. The mobile mirror 16 can be flipped and adjusted 360 degrees, which allows for a broad range of adjustability. When the user is done using the mirror assembly 10, the mobile mirror 16 can be pushed back into position on or next to the first base mirror 14 so that the entire mirror assembly rest neatly flat on the wall 100 (FIG. 1). The mirror assembly 10 can also be used with the user facing the wall or base mirror 14 and looking at the reflection in the mobile mirror 16. This gives the user flexibility in usage and placement of the mirror assembly 10.

The mirror assembly 10 can also be used in its non-extended form, i.e, folded flat on the wall as shown in FIG. 1, as a shaving mirror or like any other wall mirror. This gives the mirror assembly a broad range of functionality, contained in a single assembly.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

We claim:

1. A mirror assembly comprising a housing having a frame;

a first mirror secured within the frame;

at least one moveable arm connected at a first end to a horizontal top rail extending above the housing frame, wherein the first end is a sleeve surrounding the top rail and capable of sliding the arm laterally along the top rail;

at least one articulating joint centrally located along the moveable arm;

a second mirror connected to a second end of the movable arm, wherein the second mirror is pivotally adjustable through the articulating joint between a closed positioned and at least one open position relative to the first mirror.

2. The mirror assembly of claim 1, wherein the second mirror includes a frame with a handle.

3. The mirror assembly of claim 1, wherein the second mirror is pivotally connected to the second end of the moveable arm.

4. The mirror assembly of claim 3, wherein the second mirror is capable of pivoting 360 degrees from an initial position.

5. The mirror assembly of claim 1, wherein the second mirror is positioned adjacent to the first mirror in the closed position.

6. The mirror assembly of claim 1, wherein the second mirror is positioned extending away from the first mirror in the open position.

7. An adjustable vanity mirror assembly comprising;

a housing having a frame;

a stationary base mirror centrally positioned within the frame;

a supporting rail extending above the frame;

at least one articulating arm connected at a first end sleeve surrounding the supporting rail, wherein the arm is slidable laterally along the supporting rail through the sleeve;

a movable mirror connected to a second end of the arm, wherein the movable mirror is adjustable through the articulating arm between a closed positioned adjacent the base mirror and at least one open position extending away from the base mirror, and wherein in the open position a reflective surface of the movable mirror faces a reflective surface of the base mirror.

8. The vanity mirror assembly of claim 7, wherein the articulating arm is movable in a lateral direction along the supporting rail and capable of positioning the movable mirror in a plurality of configurations relative to the base mirror.

* * * * *